US008944756B2

(12) United States Patent
Lagueux

(10) Patent No.: US 8,944,756 B2
(45) Date of Patent: Feb. 3, 2015

(54) BLADE OUTER AIR SEAL ASSEMBLY

(75) Inventor: Ken Lagueux, Berlin, CT (US)

(73) Assignee: United Technologies Corporation, Hartford, CT (US)

( * ) Notice: Subject to any disclaimer, the term of this patent is extended or adjusted under 35 U.S.C. 154(b) by 675 days.

(21) Appl. No.: 13/183,485

(22) Filed: Jul. 15, 2011

(65) Prior Publication Data

US 2013/0017057 A1 Jan. 17, 2013

(51) Int. Cl.
*F01D 11/08* (2006.01)
*F01D 11/22* (2006.01)

(52) U.S. Cl.
CPC ..... *F01D 11/08* (2013.01); *F01D 11/22* (2013.01)
USPC ..... 415/173.2; 415/113; 415/127

(58) Field of Classification Search
CPC ..... F01D 11/08; F01D 11/14; F01D 11/20; F01D 11/22
USPC ..... 415/127, 168.4, 175, 176, 200, 1, 110, 415/113, 173.1, 173.2, 173.3, 174.1, 174.2
See application file for complete search history.

(56) References Cited

U.S. PATENT DOCUMENTS

| | | | | |
|---|---|---|---|---|
| 5,203,673 | A | 4/1993 | Evans | |
| 5,344,284 | A * | 9/1994 | Delvaux et al. | 415/173.2 |
| 5,456,576 | A | 10/1995 | Lyon | |
| 5,593,278 | A | 1/1997 | Jourdain et al. | |
| 5,601,402 | A * | 2/1997 | Wakeman et al. | 415/173.2 |
| 5,871,333 | A | 2/1999 | Halsey | |
| 7,229,246 | B2 * | 6/2007 | Ghasripoor et al. | 415/173.3 |
| 7,448,849 | B1 * | 11/2008 | Webster et al. | 415/173.1 |
| 8,186,945 | B2 * | 5/2012 | Bhatnagar et al. | 415/173.2 |
| 2005/0220610 | A1 * | 10/2005 | Ghasripoor et al. | 415/173.3 |
| 2006/0067815 | A1 | 3/2006 | Ghasripoor et al. | |
| 2010/0303612 | A1 | 12/2010 | Bhatnagar et al. | |
| 2010/0313404 | A1 | 12/2010 | Bates | |

FOREIGN PATENT DOCUMENTS

| | | |
|---|---|---|
| EP | 0808991 | 11/1997 |
| EP | 0919699 | 6/1999 |
| EP | 0790390 | 3/2003 |
| GB | 2129880 | 5/1984 |
| JP | 57041407 | 3/1982 |
| JP | 61152907 | 7/1986 |
| JP | 62248804 | 10/1987 |
| JP | 2000220407 | 8/2008 |

OTHER PUBLICATIONS

Extended European Search Report and Written Opinion for European Application No. EP 12 17 5248 completed on Jan. 21, 2014.

* cited by examiner

*Primary Examiner* — Ned Landrum
*Assistant Examiner* — Justin Seabe
(74) *Attorney, Agent, or Firm* — Carlson, Gaskey & Olds, P.C.

(57) ABSTRACT

An example blade outer air seal assembly includes a blade outer air seal that is biased toward a second part. The blade outer air seal and the second part move together radially during operation. Radial inward movement of the blade outer air seal is limited exclusively by the second part during operation.

20 Claims, 4 Drawing Sheets

BLADE OUTER AIR SEAL ASSEMBLY

DESCRIPTION OF THE RELATED ART

This disclosure relates generally to a blade outer air seal and, more particularly, to a blade outer air seal that moves radially with a blade during operation.

BACKGROUND

Gas turbine engines, and other turbomachines, include multiple sections, such as a fan section, a compressor section, a combustor section, a turbine section, and an exhaust section. Air moves into the engine through the fan section. Blade arrays in the compressor section rotate to compress the air, which is then mixed with fuel and combusted in the combustor section. The products of combustion are expanded to rotatably drive blade arrays in the turbine section. The turbine section drives rotation of the fan section and compressor section.

Turbomachines typically include arrangements of blade outer air seals circumferentially disposed about the blade arrays. During operation of the turbomachine, the tips of the blades rotate relative to the blade outer air seals. As known, improving and maintaining the sealing relationship between the blades and the blade outer air seals can desirably enhance performance of the turbomachine.

In some prior art designs, pressurized air or springs force the blade outer air seals radially inward to a fixed position. The pressurized air holds the blade outer air seals in the fixed position against hard stops as the blade arrays rotate relative to the blade outer air seals. The hard stops are generally not perfectly round or centered, whereas the blade arrays are round and centered. The radial variation in the hard stops causes the radial position of the blade outer air seals to vary, which means that the clearance between a tip of a given blade and the blade outer air seals varies as the blade array is rotated. Also, in these designs, the blade moves radially relative to the blade outer air seals during operation. Clearance between the tip of the give blade and the blade outer air seals varies for at least this reason as well. The blade outer air seal remains stationary relative to the blade because the blade outer air seals are forced against the hard stops.

SUMMARY

An example blade outer air seal assembly includes a blade outer air seal that is biased toward a second part. The blade outer air seal and the second part move together radially during operation. In this example, the second part rotates relative to the blade outer air seal during operation of a turbomachine. Radial inward movement of the blade outer air seal is limited exclusively by the second part during operation. In one example, the second part is a blade assembly, and the blade outer air seal assembly rides on the blade assembly in light contact. Some examples provide the biasing force with air pressure or a spring force.

An example blade outer air seal assembly includes a support structure and a blade outer air seal that is held exclusively axially by the support structure. The blade outer air seal is biased radially away from the support structure during operation of a turbomachine.

An example method of controlling a blade outer air seal includes biasing a blade outer air seal toward a second part and limiting the biasing exclusively with the second part. The method also moves the blade outer air seal radially with the second part during operation of a turbomachine.

DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

Figure 1:
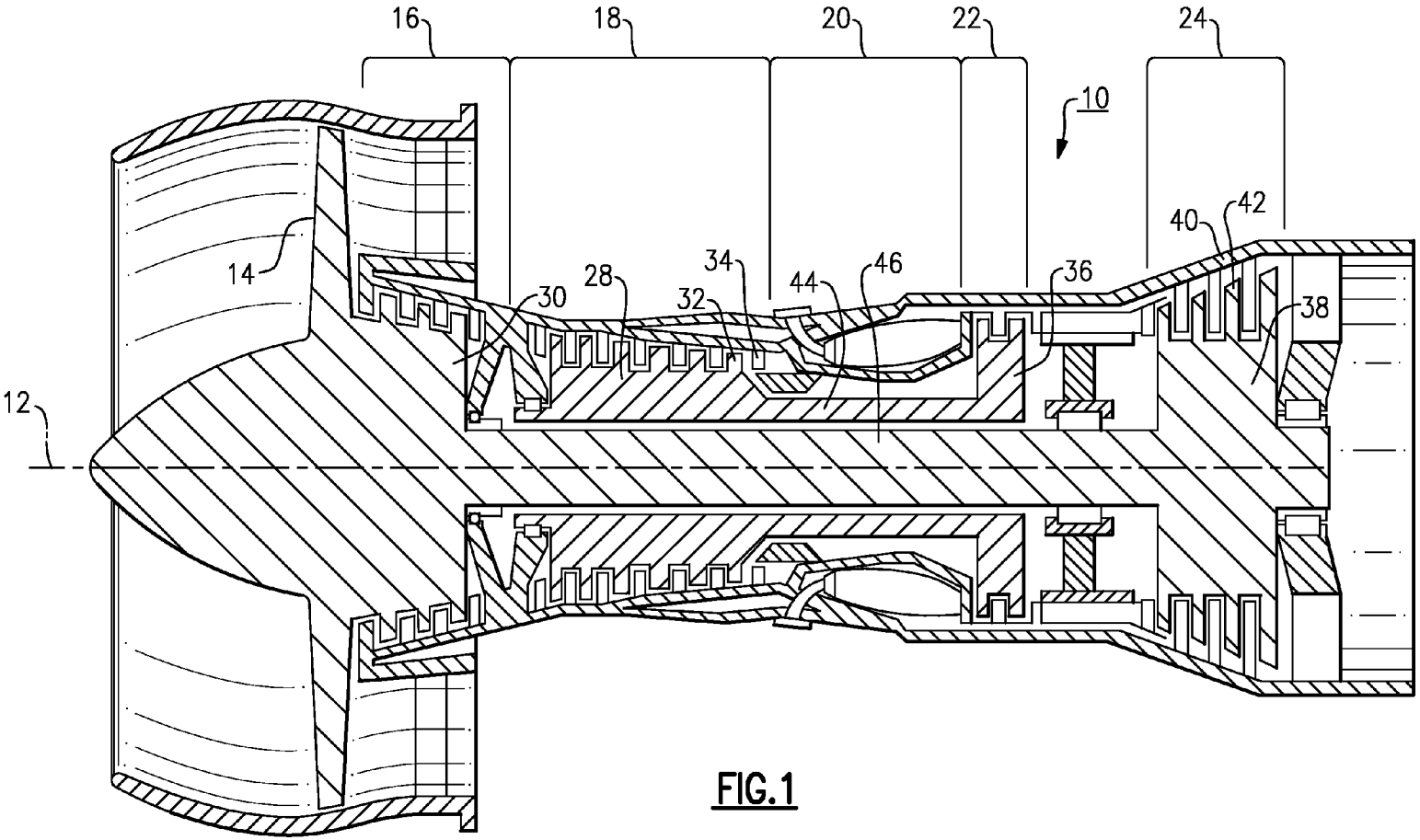
FIG. 1 shows a cross-section view of an example turbomachine.

Referring to FIG. 1, an example turbomachine, such as a gas turbine engine 10, is circumferentially disposed about an axis 12. The gas turbine engine 10 includes a fan 14, a low-pressure compressor section 16, a high-pressure compressor section 18, a combustion section 20, a high-pressure turbine section 22, and a low-pressure turbine section 24. Other example turbomachines may include more or fewer sections.

During operation, air is compressed in the low-pressure compressor section 16 and the high-pressure compressor section 18. The compressed air is then mixed with fuel and burned in the combustion section 20. The products of combustion are expanded across the high-pressure turbine section 22 and the low-pressure turbine section 24.

The high-pressure compressor section 18 and the low-pressure compressor section 16 include rotors 28 and 30, respectively, that rotate about the axis 12. The high-pressure compressor section 18 and the low-pressure compressor section 16 include alternating rows of rotatable blades 32 and static vanes 34. The blades 32 are secured to one of the rotors 28 and 30.

The high-pressure turbine section 22 and the low-pressure turbine section 24 each include rotors 36 and 38, respectively, which rotate in response to expansion to drive the high-pressure compressor section 18 and the low-pressure compressor section 16. The high-pressure turbine section 22 and the low-pressure turbine section 24 include alternating rows of rotatable blades 40 and static vanes 42. The blades 40 are each secured to one of the rotors 36 and 38.

The rotor 36 is coupled to the rotor 28 with a first spool 44. The rotor 38 is coupled to the rotor 30 with a second spool 46. The examples described in this disclosure are not limited to the two-spool gas turbine architecture described, however, and may be used in other architectures, such as the single-spool axial design, a three-spool axial design, and still other architectures. That is, there are various types of gas turbine engines, and other turbomachines, that can benefit from the examples disclosed herein.

Figure 2:
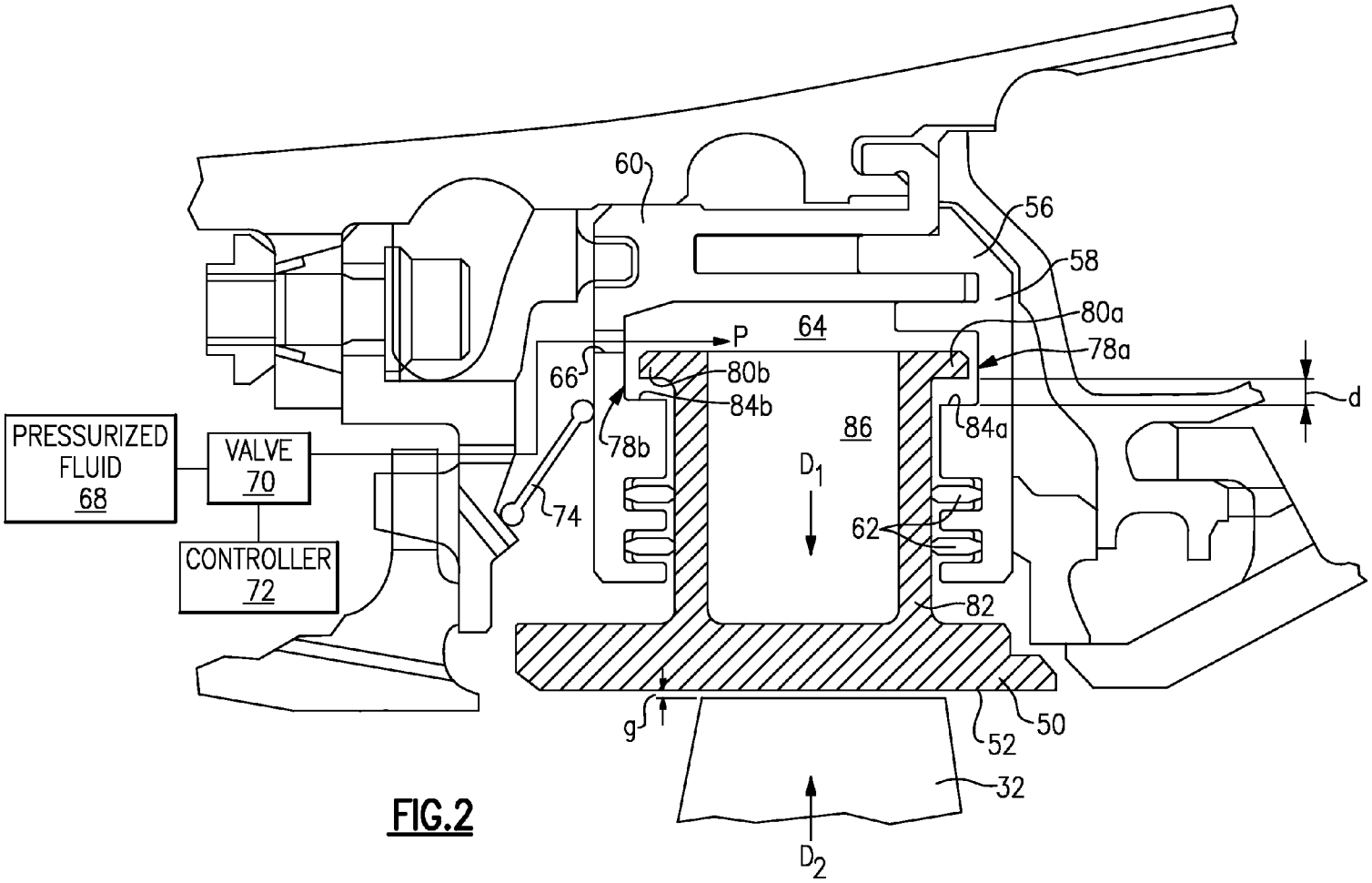
FIG. 2 shows a section view of an example blade outer air seal area within the FIG. 1 turbomachine.
Figure 3:
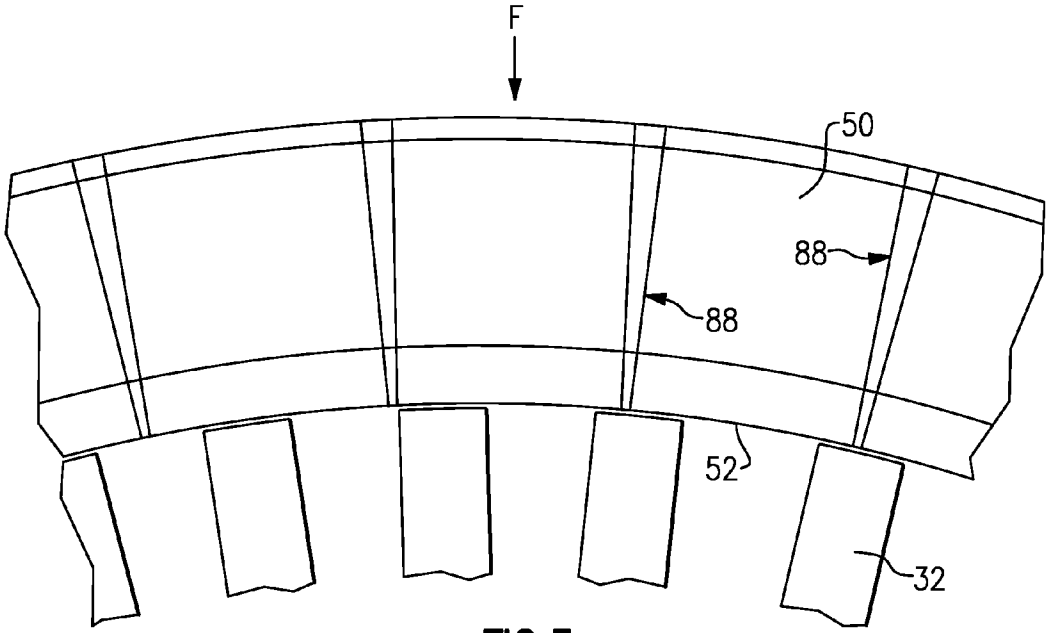
FIG. 3 shows an axial view of a portion of the blade outer air seals in the FIG. 1 turbomachine.
Figure 4:
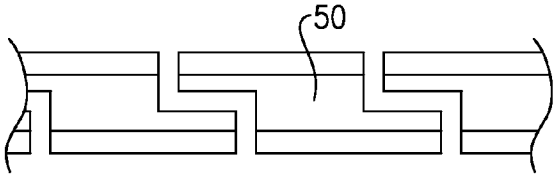
FIG. 4 shows a view of the blade outer air seals in direction F in FIG. 3.

Referring to FIGS. 2-4 with continuing reference to FIG. 1, an example blade outer air seal (BOAS) 50 includes a blade facing surface 52 that interfaces directly with a tip of the blade 32. The example BOAS 50 is within the high-pressure compressor section 18 of the engine 10. A multiple of the BOAS 50 are arranged about the axis 12. In this example, the surface 52 and the remaining portions of the BOAS 50 are made of a ceramic material, such as silicon nitride. In other examples, only the surface 52 is made of the ceramic material. Because the surface 52 is less prone to wear than prior art designs, the ceramic material can be used. In one example, the ceramic material allows light rubbing contact with the blade 32 without significantly wearing the blade 32 or the BOAS 50. The ceramic material is able to withstand the relatively high levels of thermal energy within the engine 10, which may reduce, or eliminate, a need for air cooling the BOAS 50.

In this example, a supporting structure 56 holds the BOAS 50. The supporting structure 56 includes a first portion 58 and a second portion 60, which are made of a metallic material.

The supporting structure 56 also includes a plurality of circumferential seals 62. The seals 62 are made of a ceramic material, and may be coated with lubricant to facilitate movement of the BOAS 50 relative to the supporting structure 56. The seals 62 are each a STEIN SEAL® in another example. During operation of the engine 10, the seals 62 are the only portion of the supporting structure 56 that contacts the BOAS 50.

The BOAS 50 and the supporting structure 56 establish a cavity 64. The cavity 64 receives a pressurized fluid, which moves through an aperture 66 into the cavity 64. A pressurized fluid supply 68 supplies the pressurized fluid to the cavity 64.

The pressurized fluid moves along the path P, which extends through a valve 70. A controller 72 manipulates the positions of the valve 70 to restrict or allow flow along the path P. A seal 74, which is metallic in this example, may be used to guide flow of pressurized air along the path P.

The pressurized fluid within the cavity 64 exerts a force on the BOAS 50, which biases the BOAS 50 toward the blade 32 in a direction $D_1$. As can be appreciated, introducing more pressurized fluid into the cavity 64 increases the biasing of the BOAS toward the blade $D_1$.

The BOAS 50 slides relative to the circumferential seals 62 when biased by the pressurized fluid within the cavity 64 toward the blade 32.

During operation of the engine 10, centrifugal force causes the blade 32 to move radially outward away from the axis 12 in a direction $D_2$, which is opposite the direction $D_1$. The BOAS 50 moves together with the blade 32 as the blade 32 moves in the direction $D_2$. The BOAS 50 and the blade 32 may move radially at different speeds, but both the BOAS 50 and the blade 32 move. The biasing force on the BOAS 50 keeps the BOAS 50 riding on the blade 32 regardless the radial position of the blade 32.

The blade 32 may contact the BOAS 50 when moving in the direction $D_2$, however the BOAS 50 does not resist movement of the blade 32 so much that the BOAS 50 or the blade 32 are significantly worn. The radial movement of the blade 32 causes the BOAS 50 to move radially outward. The BOAS 50 provides some resistance, but not enough to cause significant wear.

The example controller 72 controls the amount of resistance by controlling the amount of pressurized air in the cavity 64. The controller 72 may actuate a vent (not shown) to rapidly decrease the amount of pressurized air in the cavity 64, which would rapidly decrease the resistance.

As centrifugal force decreases, such as when the speed of the engine 10 is slowed, the blade 32 moves back toward the axis 12. Because the BOAS 50 is biased toward the axis 12, the BOAS 50 moves in the direction $D_1$ with the blade 32.

Moving the BOAS 50 back-and-forth radially with the blade 32 allows the BOAS 50 to maintain a relatively consistent distance from the blade 32 during operation. In this example, the controller 72 adjusts the pressure of the fluid within the cavity 64 to maintain a relatively constant loading force between the BOAS 50 and the blade 32. In another example, if less clearance between the surface 52 and the blade 32 is desired, the controller 72 may increase the pressure of the fluid within the cavity 64 to cause the BOAS 50 to become more biased in the direction $D_1$. If less clearance between the surface 52 and the blade 32 is desired, the controller 72 may introduce less pressurized fluid into the cavity 64 so that the biasing force is lessened.

Since the radial position of the BOAS 50 is not fixed during operation of the engine 10, the BOAS 50 is able to float radially with the blade 32 or ride on the blade 32. This arrangement greatly reduces wear at the interface of the BOAS 50 and the blade 32 and enhances performance of the engine.

In this example, the pressure is regulated, to achieve a minimum clearance between the BOAS 50 and the blade 50 which keeps the contact force between these parts low enough to minimize wear. The pressure may be regulated by fixing the pressure within the cavity as a percentage of the pressure at the discharge of the high-pressure compressor section 18. In another example, the pressurized fluid is a function of the speed of the engine 10. The size of a gap g between the blade 32 and the BOAS 50 may be changed by increasing or decreasing a pressure within the cavity 64.

The pressure within the cavity 64 can be regulated, for example, using the controller 72 and the valve 70. In one example, the pressure is regulated so to maintain a correct force between the BOAS 50 and the blade 32. To hold the correct force, the pressurized fluid in the cavity 64 is typically regulated to be between 60% and 70% of the compressor discharge pressure.

In this example, the supporting structure 56 includes a pair of circumferential slots 78*a* and 78*b*. Each of the circumferential slots 78*a* and 78*b* is configured to receive a corresponding tab 80*a* and 80*b*. In this example, the tabs 80*a* and 80*b* extend axially from a radially extending wall 82 of the BOAS 50.

The tabs 80*a* and 80*b* may contact surfaces 84*a* and 84*b* to hold the BOAS 50 relative to the supporting structure 56 when the engine 10 is not in operation, or prior to installation of the blades 32 within the engine 10. Notably, the example tabs 80 do not contact the surfaces 84*a* and 84*b* during operation of the engine 10 when the BOAS is riding on the blade 32. Instead, the BOAS 50 moves radially relative to the supporting structure 56 and with the blade 32. In one example, the tabs 80*a* and 80*b* are always spaced at least a distance d from the associated one of the surfaces 84*a* and 84*b*.

The radially extending wall 82 establishes a chamber 86 that forms a portion of the cavity 64. Other examples of the BOAS 50 may include other designs, or may not include the wall 82.

In this example, the radially extending edges of the BOAS 50 that interface with a circumferentially adjacent BOAS have a tongue-and-groove or shiplapped configuration. The pressurized air moves or leaks from the cavity 64 through a plurality of interfaces 88 established between the BOAS 50 and a circumferentially adjacent BOAS. The shiplap configuration ensures that the BOAS 50 and the adjacent BOAS can move radially freely without bindup. The shiplap configuration permits radial movement of the BOAS 50 relative to a circumferentially adjacent BOAS 50.

Figure 5:
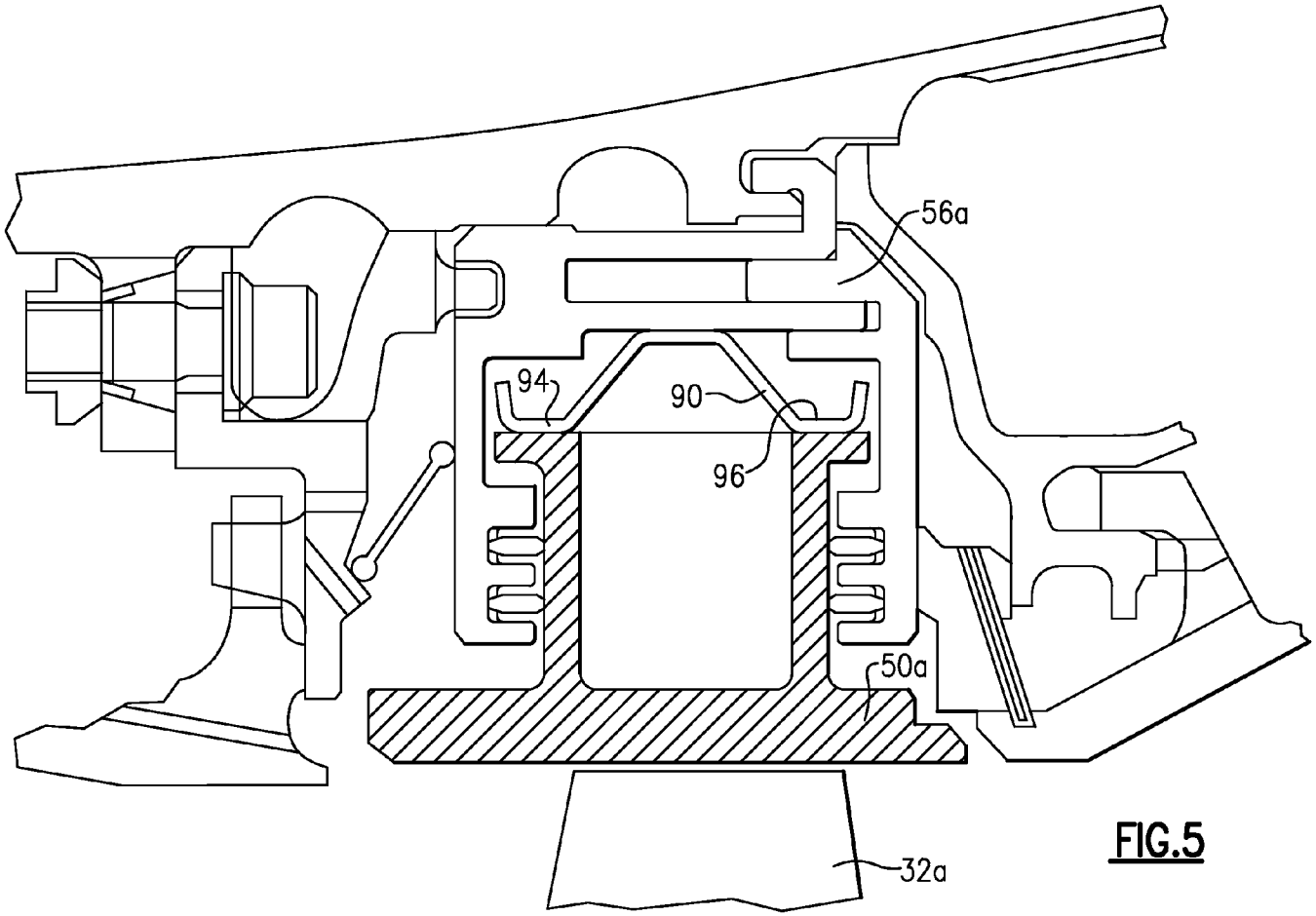
FIG. 5 shows a section view of a blade outer air seal area in another turbomachine.

Referring to FIG. 5, in another example, spring force provided by a spring 90 is used in place of the pressurized fluid in the cavity 64 (FIG. 2). The spring force ensures that the BOAS 50*a* rides on the blade 32*a*. The example spring 90 exerts sufficient force to ensure that the BOAS 50*a* is able to ride on the blade 32*a*, but not enough force to cause wear.

The example spring 90 is a circumferentially extending wave spring. The spring 90 has a central portion 92 that directly contacts a BOAS supporting structure 56*a*, and laterally outer portions 94 and 96 that directly contact the BOAS 50*a*. As can be appreciated, the spring 90 flexes as the blade 32*a* moves radially inward and outward relative to the axis. A person having skilling this art and the benefit of this disclosure would be able to select such a spring having a spring force appropriate for exerting sufficient force on the BOAS 50 to allow the BOAS 50 to ride on the blade 52*a*, but not enough force to wear the blade 32*a* and BOAS 50*a* due to contact between the blade 32*a* and the BOAS 50*a*.

Features of the disclosed examples include a BOAS that float radially with a blade during operation. Moving the BOAS with the blade during operation reduces wear on the BOAS. The BOAS is thus able to be made of materials that are able to withstand high levels of thermal energy, which are not typically used because of wear. In one example, the BOAS is a ceramic material that withstands high thermal energy levels and does not require cooling air. The ceramic material also ensures low wear.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

I claim:

1. A blade outer air seal assembly of a turbomachine, comprising:

a blade outer air seal that is biased toward a second part, wherein the blade outer air seal and the second part move together radially during operation, and the second part rotates relative to the blade outer air seal during operation of the turbomachine, wherein radial inward movement of the blade outer air seal is limited exclusively by the second part during operation, wherein the blade outer air seal is biased radially inward with a pressurized fluid; and a supporting structure comprising at least one circumferential seal, wherein the blade outer air seal is supported exclusively during operation with the at least one circumferential seal, or is supported exclusively during operation with the at least one circumferential seal together with at least one circumferentially adjacent blade outer air seal, the second part, or both.

2. The blade outer air seal assembly of claim 1, wherein the blade outer air seal is biased toward the second part with the pressurized fluid.

3. The blade outer air seal assembly of claim 1, wherein the blade outer air seal has a ceramic surface configured to contact the second part.

4. The blade outer air seal assembly of claim 1, wherein the second part is a blade of a blade array.

5. The blade outer air seal assembly of claim 1, wherein the second part is rotatable about an axis and the radial inward movement of the blade outer air seal is movement toward the axis.

6. The blade outer air seal assembly of claim 1, wherein the blade outer air seal has a shiplapped configuration.

7. The blade outer air seal assembly of claim 2, wherein the pressurized fluid is communicated through an interface established between the blade outer air seal and a circumferentially adjacent blade outer air seal.

8. The blade outer air seal assembly of claim 2, including a wall extending radially from a surface that faces away from the second part, the wall establishing a chamber that receives the pressurized fluid.

9. The blade outer air seal assembly of claim 1, wherein the blade outer air seal is configured to move radially independent from another, circumferentially adjacent, blade outer air seal.

10. A blade outer air seal assembly of a turbomachine, comprising:

a supporting structure;

a blade outer air seal that is held axially by the supporting structure, wherein the blade outer air seal is biased radially away from the supporting structure during operation of the turbomachine; and at least one circumferential seal, wherein the blade outer air seal is supported exclusively during operation with the at least one circumferential seal, or is supported exclusively during operation with the at least one circumferential seal together with at least one circumferentially adjacent blade outer air seal, a blade, or both.

11. The blade outer air seal assembly of claim 10, wherein pressurized fluid biases the blade outer air seal toward the blade.

12. The blade outer air seal assembly of claim 11, wherein the supporting structure establishes a cavity with the blade outer air seal and the cavity receives the pressurized fluid.

13. The blade outer air seal assembly of claim 10, wherein at least one of the supporting structure and the blade outer air seal has a tab that is configured to be received within a slot established in the other of the supporting structure and the blade outer air seal, the tab contacting edges of the slot to limit relative movement between the blade outer air seal and the supporting structure.

14. The blade outer air seal assembly of claim 11, including a controller that actuates a valve to selectively increase a pressure of the pressurized fluid.

15. The blade outer air seal assembly of claim 10, wherein the blade outer air seal is biased toward a blade of a blade array, and the blade outer air seal moves radially with the blade during operation.

16. The blade outer air seal assembly of claim 10, wherein the blade outer air seal is ceramic.

17. The blade outer air seal assembly of claim 10, wherein the supporting structure holds at least one other blade outer air seal.

18. A method of controlling a blade outer air seal comprising, biasing a blade outer air seal toward a second part using a pressurized fluid;

limiting the biasing exclusively with the second part;

moving the blade outer air seal radially with the second part during operation of a turbomachine; and supporting the blade outer air seal during operation exclusively with at least one circumferential seal, or supporting the blade outer air seal during operation exclusively with the at least one circumferential seal together with at least one circumferentially adjacent blade outer air seal, the second part, or both.

19. The method of claim 18, increasing a pressure of the pressurized fluid to increase the biasing.

20. The method of claim 18, wherein the blade outer air seal is ceramic.

* * * * *